United States Patent [19]

Krieger

[11] 4,182,585

[45] Jan. 8, 1980

[54] DOUBLE-PLATE CONTROL DEVICE

[75] Inventor: Karl Krieger, Wuppertal, Fed. Rep. of Germany

[73] Assignee: Hermann Hemscheidt Maschinenfabrik GmbH & Co., Wuppertal, Fed. Rep. of Germany

[21] Appl. No.: 949,013

[22] Filed: Oct. 6, 1978

[30] Foreign Application Priority Data

Oct. 11, 1977 [DE] Fed. Rep. of Germany ..... 2745631

[51] Int. Cl.[2] ..... E21D 15/44

[52] U.S. Cl. ..... 405/302; 91/508; 60/DIG. 10; 91/530; 137/315

[58] Field of Search ..... 405/291-302; 299/31, 33; 91/170 MP, 414, 530, 508; 137/315; 60/458, DIG. 10

[56] References Cited

U.S. PATENT DOCUMENTS

| | | | |
|---|---|---|---|
| 3,215,158 | 11/1965 | Bass et al. | 137/115 X |
| 3,821,880 | 7/1974 | Weirich et al. | 405/302 |
| 3,906,727 | 9/1974 | Hull | 60/DIG. 10 |
| 4,049,014 | 9/1977 | Johnson et al. | 137/115 |

FOREIGN PATENT DOCUMENTS

| | | | |
|---|---|---|---|
| 2132981 | 1/1973 | Fed. Rep. of Germany | 405/302 |
| 2225196 | 12/1973 | Fed. Rep. of Germany | 405/302 |
| 2714160 | 3/1977 | Fed. Rep. of Germany | 91/414 |
| 2640185 | 3/1978 | Fed. Rep. of Germany | 405/302 |
| 1216712 | 12/1970 | United Kingdom | 405/302 |

*Primary Examiner*—Dennis L. Taylor

*Attorney, Agent, or Firm*—Berman, Aisenberg & Platt

[57] ABSTRACT

A control device serves to control the fluid flow to and from double-acting rams, especially the rams of mining machinery, the control device having various internal ducts which are defined between two plates connected together. One of the two plates (a duct plate) has a main face formed with channels, some of which radiate outwardly from a ring of bores, and two of which are 'T'-shaped and extend generally tangential to the ring of bores. The other plate (a connecting plate) closes the channels to define ducts and has bores communicating with the various ducts. Control valve units are detachably connected to the connecting plate, the control valve units being arranged to be actuated to effect desired connections between the various ducts by way of the bores in the connecting plate.

8 Claims, 5 Drawing Figures

DOUBLE-PLATE CONTROL DEVICE

This invention relates to a control device incorporating a plurality of control valves for use in controlling the operation of hydraulically-actuated equipment, such as hydraulic, walking mine-roof supports and other equipment used in mining.

Such a control device can be used for controlling the operation of a plurality of double-acting rams. The achieve this, the control device is connected to a source of fluid under pressure, to a fluid resevoir, and to both ends of each double-acting ram cylinder. The control device has a number of internal passages which are interconnected within the control device in various ways determined by the operating positions of the control valves. The positions of the control valves determine which end of each cylinder is connected to a source of fluid under pressure and which end is connected to a fluid reservoir, so that each ram is extended or retracted selectively by operation of the control valves.

For reasons of safety, it is usually desirable that the control device be remote from the double-acting rams which it controls, and thus the control device can be connected to a hose line comprising a bundle of narrow-bore fluid lines, such fluid lines comprising a fluid supply line, a fluid return (or reservoir) line, and two lines from each double-acting ram. The end of the hoseline terminates in a connector element, e.g. a plug, detachably connected to a co-operating connector element, e.g. a socket, on the control device.

In our United Kingdom Patent Application No. 36346/77 filed on 31st Aug. 1977, as well as in the corresponding United States Patent Application Ser. No. 830,892 filed on 6th Sept. 1977 and Japanese Patent Application No. 107664/77 filed on 7th Sept. 1977, there is described a control device comprising a block having end faces and side faces. Various passages in the block extend from a connector element at an end face of the block to openings on two opposite side faces of the block. The control valves are incorporated in valve units detachably connected to the side faces of the block. This arrangement has the advantage that the interior of the control device is readily accessible for maintainance by removal of the detachable valve units. However, the control device is expensive to manufacture because the passages within the block are formed by longitudinal and transverse bores which extend deeply into the block, and which must meet up with one another very accurately. The formation of the passages through the block thus requires a large amount of very accurate machining which is very time-consuming and thus expensive.

An aim of the present invention therefore is to provide a control device which is readily accessable for maintainance, which avoids the need for boring holes accurately into a block, and which can be made to a very compact design. With this aim in view, the invention is directed to a control device comprising a fluid distributing block and a plurality of control valve units detachably mounted on the block, the block comprising a duct plate and a connecting plate, wherein:

(a) the duct plate comprises a first main face, a second main face, and bores extending through the plate to connect said main faces, the said bores terminating on said first main face in a plurality of openings, namely an inlet opening, an outlet opening, and a plurality of control line openings, which plurality of openings are for connection in use of the control device to fluid lines, channels extending on the said second main face, each said channel being connected to a corresponding one of said plurality of openings on the first main face by way of said bores, the bores being arranged in a ring on said second main face, said channels comprising a plurality of first channels of various lengths radiating outwardly from said ring, said first channels each being connected by way of a said bore to a respective one of said control line openings, a second channel communicating with said inlet opening, and a third channel communicating with the outlet opening, the second and third channels each being longer than any of said first channels;

(b) the connecting plate has a first main face abutting said duct plate to close said channels and thus define ducts, there being passages extending through said connecting plate, said passages opening on the first main face of the connecting plate at positions communicating each with a said duct; and (c) the control valve units are detachably connected to said connecting plate and have valve passages in communication with the passages through the connecting plate.

A preferred embodiment of a control device according to the invention will now be described by way of example and with reference to the accompanying drawings in which.

Figure 1:
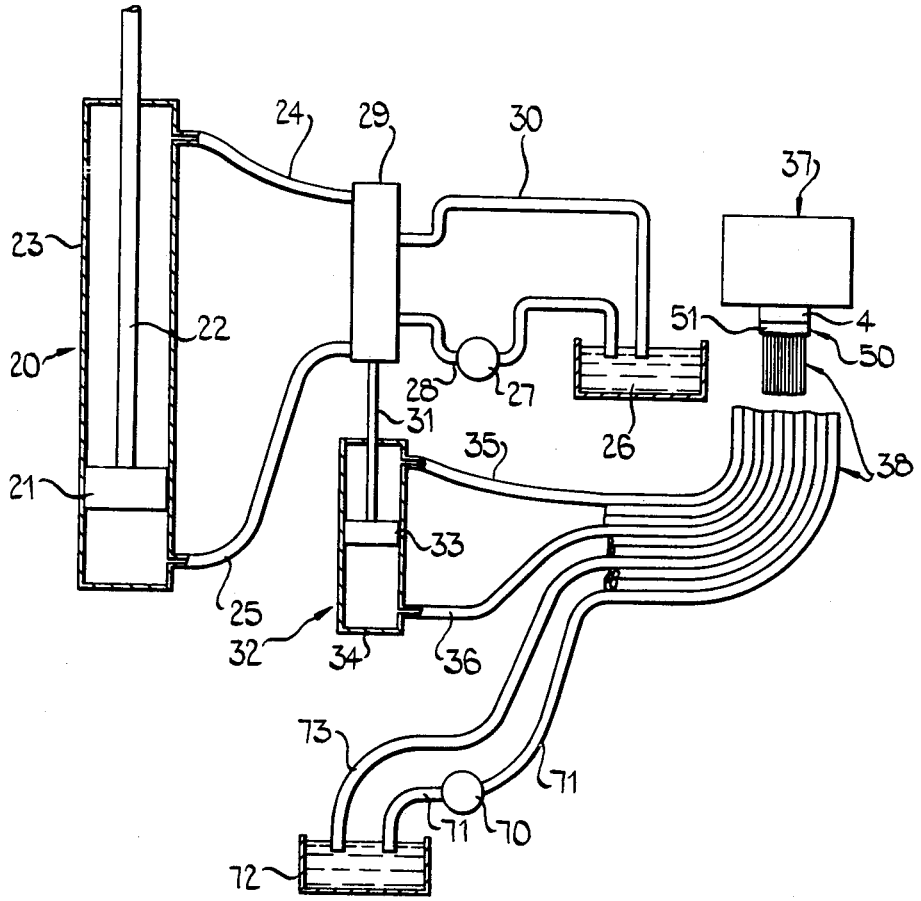
FIG. 1 is a diagrammatic view, not to scale, showing a ram of a walking roof support, and a main valve for operating such ram, the main valve being operated by a double acting unit controlled by a control device according to the invention.
Figure 2:
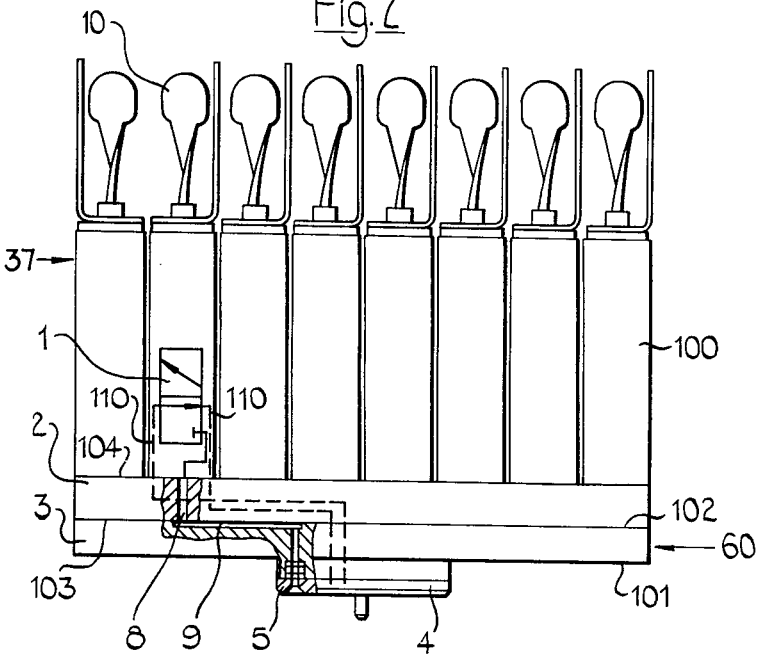
FIG. 2 is a diagrammatic side view of the control device shown in FIG. 1.
Figure 3:
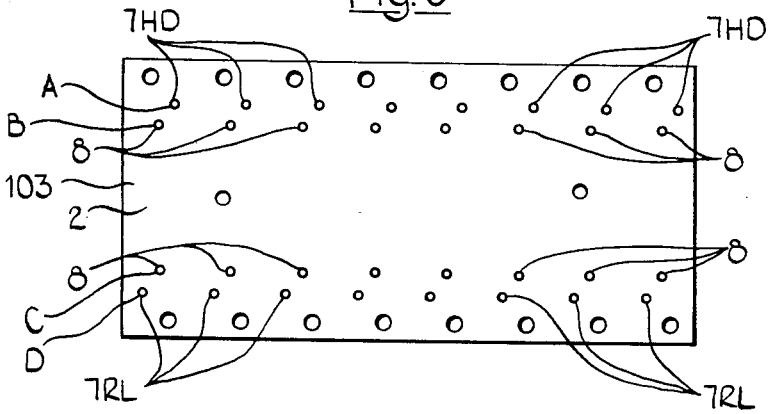
FIG. 3 is a top plan view of a connecting plate of the control device shown in FIG. 2.

FIG. 1 shows diagrammatically a ram 20 of a hydraulic walking roof support for supporting a mine roof adjacent a work face. Such walking roof support will include a number of such rams, some of which will be used in known manner to advance the support with respect to a working face, and others of which will be used for extending and retracting roof props of the support. The illustrated ram 20 is double acting, and comprises a piston 21 mounted on a piston rod 22 and slidable in a cylinder 23. The cylinder 23 has connected to it two fluid flow lines 24 and 25, the line 24 communicating with the ram cylinder 23 on one side of the piston 21, whilst the fluid flow line 25 communicates with the ram cylinder 23 on the other side of the piston 21.

A reservoir of hydraulic fluid is shown at 26, and a pump 27 serves to deliver fluid under high pressure by means of a delivery line 28 to a main valve 29 which is shown diagrammatically. The main valve 29 has a return line 30 communicating with the reservoir 26. The internal construction of the main valve 29 is not shown, and the valve may be of any known type suitable for the intended purpose. The valve 29 is operable between two positions by means of an actuating rod 31. In a first of the positions the valve 29 supplies fluid under high pressure from the reservoir 26 via the fluid line 25 to the cylinder 23 on one side of the piston 21. This causes the ram 20 to extend, and fluid expelled from the ram cylinder 23 by the advancing piston 21 flows via line 24 to the valve 29 and thence to the reservoir 26. In the other operating position of the main valve 29, the flow of fluid is reversed by the main valve so that the ram is retracted. The actuating rod 31 of the main valve 29 is itself arranged to be moved by means of a switching unit shown diagrammatically at 32. The switching unit 32, like ram 20, is a double-acting device, and comprises a piston 33 connected to the actuating rod 31 of the main valve 22 and slidably disposed in a cylinder 34. Connected to the cylinder 34 of the switching device 32, one on either side of the piston 33, are a pair of fluid flow lines 35 and 36. Fluid under low pressure can be fed to the switching unit 32 selectively either via the line 35 or via the line 36. The switching device 32 operates in a manner similar to the ram 20, so that the main valve 29 can be moved between its operating positions by supplying fluid under low pressure selectively either to line 35 or line 36. Lines 35 and 36 may be regarded as control lines since they control the position of the switching units.

The source of fluid under low pressure for operating the switching device is pump 70 delivering fluid via a line 71 from a reservoir 72 to which a return line 73 is connected.

The supply of fluid to the various switching units 32 associated with a walking roof support is controlled by a control device 37 (only part of which is shown in FIG. 1) which is connected by means of a connector 50 to a hoseline 38. The connector 50 comprises a plug part 51 on the end of the hoseline and a socket 4 on the control device. The hoseline 38 contains a bundle of fluid flow lines comprised of lines 71 and 73 which are connected to reservoir 72, lines 35 and 36 associated with the illustrated switching unit 32, and fourteen other lines associated with seven other switching units (not shown). As will be described in more detail below, the control device 37 includes sixteen control valves 1, one for each switching unit line 35, 36 to be controlled. The valves 1 are arranged in pairs to form eight valve units 100.

Figure 4:
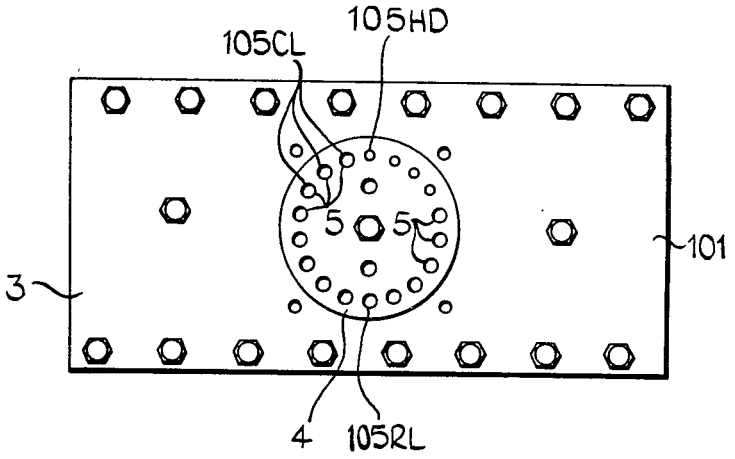
FIG. 4 is a plan view of a duct plate of the control device shown in FIG. 2.

As shown in FIGS. 2 to 5, the control device 37 comprises a fluid distributing block 60 of rectangular cross-section and comprised of a duct plate 3 and a connecting plate 2, plates 2 and 3 being connected together either permanently, as by welding, or detachably, as by bolts. The duct plate 3 is formed on one of its main faces 101 with the connector element 4 mentioned above, element 4 being a socket having a plurality of openings 105 arranged spaced apart around the circumference of a circle as best seen in FIG. 4. The openings 105 comprise an inlet opening 105 HD, an outlet opening 105 RL, and sixteen other openings 105 CL. These openings 105 CL may be regarded as control line openings because they are connected to control lines 35, 36.

The plug 51 and hoseline 38 serve to connect inlet opening 105 HD to supply line 71: outlet opening 105 RL to fluid reservoir return line 73: and the sixteen openings 105 CL to respective ones of sixteen control lines (such as lines 35 and 36) connected to eight switching units 32.

Figure 5:
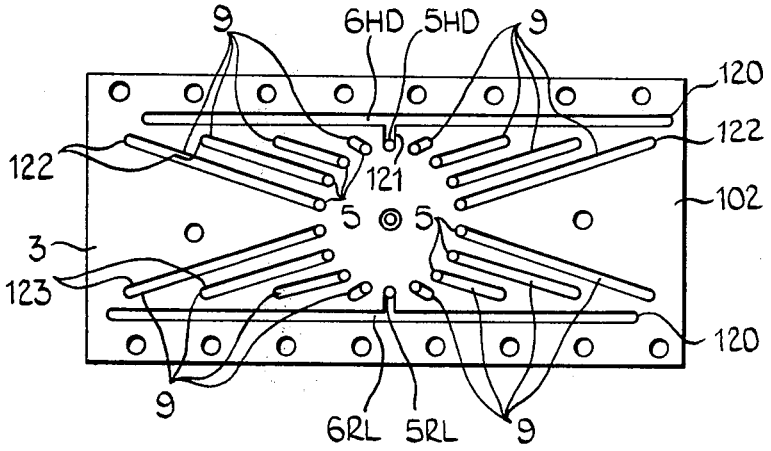
FIG. 5 is a top plate view of the duct plate of FIG. 4.

FIG. 5 shows the face 102 of the duct plate which is remote from the socket 4 and which abuts plate 2. The face 102 has various channels 6 and 4 formed in it, and these channels can be formed by milling, stamping or casting. The channels are each connected to a corresponding one of the openings 105 (CL, HD, or RL) by way of bores 5, 5HD, and 5RL which are arranged in a ring on face 102. The ring is preferably circular as shown in the illustrated embodiment, but it could be of another shape, for example oval.

The channels comprise a plurality of channels 9 of various lengths radiating approximately radially outwardly from the ring of bores 5. These channels 9 are each connected by way of a respective bore 5 to a respective one of the control line openings 105 CL.

In addition to the several channels 9 there are two other channels 6 HD and 6 RL. Channel 6 HD communicates with opening 105 HD by way of bore 5 HD, and similarly channel 6 RL communicates with opening 105 RL by way of bore 5 RL. The channels 6 HD and 6 RL are both 'T'-shaped and are disposed on opposite sides of the ring of bores 5. The 'T'-shaped slots have bar portions 120 and stem portions 121. The two stem portions 121 extend from the ring in mutually opposite radial directions, whilst the bar portions 120 (each of which is longer than any of channels 9) extend parallel to each other tangentially of the ring bores.

Half of the channels 9 extend towards the bar portion 120 of channel 6 HD, the channels 9 ending short of such bar portion 120 to terminate at points 122 all disposed on a straight line parallel to and adjacent to the bar portion 120 of T-shaped channel 6 HD. The other half of the channels 9 extend towards the bar portion of channel 6 RL and these also terminate at points 123 disposed on a second straight line. The points 122 are equally spaced apart, and so are the points 123. Also, the spacing between each point 122 and the nearest point 123 is constant for all such points 122, 123.

The connecting plate 2 has two opposite main faces 103 and 104, and these faces are generally identical to one another. Face 103 abuts the face 102 of the duct plate to close the channels 6 (HD and RL) and thus ducts are defined between the channels and connecting plate. The plates 2 and 3 can be welded together, or can be bolted together in which case seals may be necessary.

Passages comprised by straight bores 7, 8 extend through the connecting plate 2 from face 103 to face 104. Bores 7 HD extend in a first straight line, and these bores all register with the bar portion 120 of channel 6 HD. Similarly, bores 7 RL extend in a second straight line and these bores all register with the bar portion 120 of channel 6 RL. There are two sets of bores 8. The bores 8 of each set are disposed in respective straight lines parallel to each other. The bores 8 of one of the lines of such bores each register with the termination points 122 of respective channels 9, whilst the bores 8 of the other line of such bores each register with the termination points 123 of respective channels 9.

Eight valve units 100 are detachably mounted, for example by bolts, on the face 104 of the duct plate. Each valve unit comprises two valves, only one of which is shown at 1 in FIG. 2. A valve unit will have four openings on its surface which abuts face 104 of the connecting plate. The four openings will register with respective bores 7 and 8 in the connecting plate, and four of the bores 7, 8, which will register with corresponding openings in an end valve unit are shown at A, B, C and D in FIG. 3.

The precise internal construction of the valve units is not important and is not shown in detail. However, the function of each valve unit is to connect the pressure supply bore A to one of the bores B or C, and to connect the outlet bore D to the remaining bore B or C. Thus, by way of bores 5, channels 9, and internal passages 110 within each valve unit, one control line 35 or 36 of a switching unit will be connected via channel 6

HD to the pressure supply line 71 whilst the other control line 35 or 36 is connected to the reservoir 72 via channel 6 RL.

It will be understood that the control device described can be of very compact construction, and the control valve units can readily be removed from plate 2 for maintainance. Also, the use of the channels 6 and 9 avoids the need to drill accurately meeting bores deep into the block.

I claim:

1. A control device for controlling hydraulically actuated equipment, the device comprising a fluid distributing block and a plurality of control valve units detachably mounted on the block, the block comprising a duct plate and a connecting plate, wherein:

(a) the duct plate comprises a first main face, a second main face, and bores extending through the duct plate to connect said main faces, the said bores terminating on said first main face in a plurality of openings, namely, an inlet opening, an outlet opening, and a plurality of control line openings, which plurality of openings are for connection, in use of the control device, to fluid lines, channels extending on the said second main face, each said channel being connected to a corresponding one of the said plurality of openings on the first main face by way of said bores, the bores being arranged in a ring on said second main face, said channels comprising a plurality of first channels of various lengths radiating outwardly from said ring, said first channels each being connected by way of a said bore to a respective one of said control line openings, a second channel communicating with said inlet opening, and a third channel communicating with the outlet opening, the second and third channels each being longer than any of said first channels;

(b) the connecting plate has a first main face abutting said duct plate to close said channels and thus define ducts, there being passages extending through said connecting plate, said passages opening on the first main face of the connecting plate at positions communicating each with a said duct; and (c) the control valve units are detachably connected to said connecting plate and have valve passages in communication with the passages through the connecting plate.

2. A control device as claimed in claim 1, in which the second and third channels are disposed on opposite sides of the said ring and are both T-shaped in that they comprise a short stem portion and a longer bar portion, the stem portions extending radially in mutually opposite directions, and the longer bar portions both extending generally tangentially and parallel to one another.

3. A control device as claimed in claim 1, in which the first channels lie between the bar portions of the second and third channels, some of said first channels extending towards the bar portion of the second channel and terminating at points lying on a first straight line, and others of the first channels extending towards the bar portion of the third channel and terminating at points disposed on a second straight line.

4. A control device as claimed in claim 1, in which the connecting plate has a second main face opposite its first main face, the valve units being detachably mounted on said second main face.

5. A control device as claimed in claim 4, in which the passages through the connecting plate are comprised by bores, and in which the spacing between the bores associated with any of the valve units is the same as the spacing between the bores associated with any of the other valve units.

6. A control valve as claimed in claim 5, in which the bores in the connecting plate are parallel to the bores in the duct plate.

7. A control device as claimed in claim 1, and further comprising: a walking roof support; rams for operating the walking roof support; a source of high pressure fluid; main valves for controlling the supply of high pressure fluid to the rams; switching units for actuating the main valves; a source of fluid under low pressure; a return line for returning the low pressure fluid to a reservoir; control lines connecting the switching units to respective control line opening of the control device block; a line connecting the source of fluid under low pressure to the inlet opening of the block; and a line connecting the return line for the low pressure fluid to the outlet opening on the block.

8. A control device as claimed in claim 7, in which the lines connected to the control device are comprised by a hoseline terminating in a plug, and in which the control device is formed with a socket unit to which the plug unit is connected.

* * * * *